United States Patent [19]

Gulden et al.

[11] 4,421,476

[45] Dec. 20, 1983

[54] GASIFICATION BURNER

[75] Inventors: Peter Gulden; Alfred Michel, both of Erlangen; Hana Kostka, Nuremberg, all of Fed. Rep. of Germany

[73] Assignee: Siemens Aktiengesellschaft, Munich, Fed. Rep. of Germany

[21] Appl. No.: 376,569

[22] Filed: May 10, 1982

Related U.S. Application Data

[63] Continuation of Ser. No. 77,041, Sep. 19, 1979, abandoned.

[30] Foreign Application Priority Data

Sep. 21, 1978 [DE] Fed. Rep. of Germany ..... 2841105

[51] Int. Cl.[3] ..... F23D 13/14; F23D 13/42

[52] U.S. Cl. ..... 431/243; 431/208; 431/328; 239/132.3

[58] Field of Search ..... 431/167, 242, 243, 328, 431/329, 7, 79, 208, 354; 239/132.3

[56] References Cited

U.S. PATENT DOCUMENTS 3,155,142 11/1964 Stack ..... 431/328

3,484,189 12/1969 Hardison et al. ..... 431/243

3,825,913 7/1974 Metcalf et al. ..... 431/79

4,230,443 10/1980 Berg et al. ..... 431/328

*Primary Examiner*—Lee E. Barrett

*Attorney, Agent, or Firm*—Kenyon & Kenyon

[57] ABSTRACT

In a gasification burner comprising an antechamber for mixing fuel and primary air; a catalytic device for generating a fuel gas from the fuel/primary air mixture; a mixing chamber for mixing the fuel gas with secondary air; an annular space which surrounds the antechamber, the catalytic device and the mixing chamber being separated from the antechamber by a ring wall provided with radial canals; a combustion chamber and a burner plate terminating the combustion chamber; and an ignition chamber arranged between the combustion chamber and the mixing chamber the operating safety is increased by having the annular space also enclose the ignition chamber and the combustion chamber in ring-fashion and extend up to the vicinity of the burner plate; a primary air feed stub opening into the annular space; and baffles in the annular space which baffles conduct the primary air stream from the primary air feed stub to the radial canals of the ring wall in spiral or meander fashion about the combustion chamber and the ignition chamber.

11 Claims, 3 Drawing Figures

GASIFICATION BURNER

This is a continuation of application Ser. No. 077,041 filed Sept. 19, 1979, now abandoned.

BACKGROUND OF THE INVENTION

This invention relates to gasification burners in general and more particularly to a gasification burner with improved efficiency and increased safety features.

A gasification burner comprising an antechamber for mixing an at least partly evaporated liquid fuel with primary air; a catalytic device following the antechamber for converting the fuel vapor air mixture into a fuel gas; a mixing chamber adjoining the catalytic device for mixing the fuel gas with secondary air; an annular space which concentrically surrounds the antechamber, the catalytic device and the mixing chamber and is separated from the antechamber by a ring wall; a conically flared combustion chamber and a perforated burner plate of porous material which terminates the combustion chamber and to which the fuel gas-air mixture can be fed from the mixing chamber; a front chamber located ahead of the antechamber, which changes into a ring canal which surrounds the antechamber completely and surrounds the annular space and the catalytic device at least over part of their length; a heat source contained in the ring canal for evaporating the fuel and a heat source contained in the annular space for preheating the primary air during the starting process and for aiding in the event of load changes; radial canals which are contained in the ring wall and which connect the annular space to the antechamber; homogenizing devices, arranged in the antechamber and in the mixing chamber; and an ignition chamber which is arranged between the combustion chamber and the mixing chamber and is separated from the mixing chamber to prevent backfiring is described in U.S. Pat. No. 4,230,443.

In this gasification burner, liquid fuel is burned in two stages. In the first stage only part of the total amount of air supplied is mixed as gasification air (primary air) with the fuel and is converted by partial catalytic oxidation (understoichiometric combustion) into a fuel gas. In the second stage, the fuel gas is mixed with the rest of the air (combustion air, secondary air) and burned at a burner plate.

In domestic burners of conventional design, the fuel is atomized in a nozzle and burned with the total air in a combustion chamber. Since the atomizer output can be varied only within narrow limits, such domestic burners cannot be continuously controlled down to small outputs. Rather, they are planned for maximum output and, if the heating demand is low, are controlled in intermittent operation by means of an on-off control. This necessitates larger boilers as energy accumulators for the pauses in the operation, and further, the repeated starting-up of the burner causes a heavy temperature cycle stress of the materials, an increased soot and pollutant burden for the boiler, flue and exhaust gases as well as excessive power demand during the electric ignition. The gasification burner proposed in the previous patent, on the other hand, needs to be started only at the beginning of a heating period and can then be controlled continuously, according to the heat demand, down to very small outputs, which avoids the disadvantages mentioned. In addition, a substantial reduction of the emission of pollutants such as unburned hydrocarbons and nitrogen oxides in the course of the reaction during the combustion is achieved. The total amount of air required can then be limited to the air required for stoichiometric combustion, whereby high combustion temperatures can be achieved.

One preferred embodiment of the gasification burner proposed in the patent mentioned above is shown in FIG. 1 and consists, as already mentioned, of two stages, i.e., a gasification stage with a centrally arranged reaction chamber 2 (catalytic device) which contains a catalyst, and a combustion part which comprises a mixing chamber 3, an ignition chamber 7 and a conically flared combustion chamber 8 with a terminating porous, perforated burner plate 9. The catalytic device 2 is preceded at its inlet 14 by an antechamber 1 for mixing the fuel with primary air. The antechamber 1 is laterally confined by a ring wall 5 and connected, via radial canals 6 in this ring wall, to an annular space 4, which concentrically surrounds the antechamber 1, the catalytic device 2 and the mixing chamber 3. Through the annular space 4, the primary air is fed to the antechamber 1.

For feeding the fuel in, the antechamber 1 is preceded by a front chamber 10, which becomes a ring canal 11 which surrounds the antechamber 1 completely and the annular space 4 as well as the catalytic device 2 at least over part of their length. The fuel is evaporated at least partly at a first heat source 12 arranged in the ring canal 11 and is mixed in the antechamber 1 with the primary air, which is pre-heated at a second heat source B arranged in the annular space 4, at a first homogenizing device 13, for instance, a swirl vane. The fuel gas generated in the catalytic device 2 is conducted into the mixing chamber 3 and is mixed there at a second homogenizing device 24, for instance, another swirl vane, with secondary air which is fed in.

In an advantageous further embodiment of such a gasification burner, it is further proposed in the previous patent that the reactor chamber 2 (catalytic device) comprises a catalytically inactive container A, at the end faces of which inlet holes 14 and outlet holes 15 are arranged. Furthermore, a perforated disc 16 can be arranged between the mixing chamber 3 and the ignition chamber 7 for protection against backfiring. The ignition chamber 7 can, in addition, be separated from the combustion chamber 8 by a perforated wall 17. For feeding the fuel to the ring canal 11 (evaporation chamber), a fuel connecting nipple 19 is provided; for feeding the secondary air to the mixing chamber 3, a secondary air connecting nipple 23 is provided; and for feeding the primary air to the annular space 4 (preheater chamber), a primary-air feed nipple 26 is provided. At the wall of the ignition chamber 7, a further nipple 27 for an ignition device is also fastened. In the mixing chamber 3 a catalytically inactive lining C, for instance, for ceramic can advantageously be provided.

The housing of the proposed gasification burner is advantageously composed of several parts, for instance, of a cylindrical first housing part 18 surrounding the first stage, with a front cover 20; a middle part 21 surrounding the mixing chamber 3; and a cylindrical end part 25 which carries a conical enlargement surrounding the combustion chamber 8. These housing parts are advantageously made of metal, for instance, stainless steel. In particular, the wall 22 between the mixing chamber 3 and the annular space 4 is made heat conducting, so as to achieve preheating of the primary air in the combustion part.

It has now been found that the proposed gasification burner is prone in some cases to operating trouble. Thus, if the fuel supply fails temporarily, no combustion takes place in the combustion part for a short time. The primay air being fed in is then not pre-heated sufficiently, so that cold air flows through the catalytic part and the latter cools off. When the fuel supply is resumed, the catalytic device then does not work satisfactorily, so that the fuel is only converted incompletely into fuel gas and trouble comes about in the burner, especially soot formation in the combustion part. While it is the express advantage of this burner that very high combustion temperatures can be achieved through stoichiometric air supply, these high temperatures bring with them the danger that the materials used can be destroyed. Thus, the burner plate 9 or the perforated wall 17, for instance, can crack and even the metal housing can become unwelded. To avoid this danger, in the burner proposed in the previous patent application, the end of the device, at which the burner plate is located is fastened to the wall of the boiler, so that the housing is arranged outside the boiler and is cooled by the ambient air. This, however, makes the burner no longer contact-proof, since the danger of injury is considerable if the burner housing is touched. Also, the heat losses which then occur at the housing mean a decrease of the efficiency of the burner.

SUMMARY OF THE INVENTION

It is an object of the present invention to increase the operating safety of a gasification burner of the type mentioned at the outset which comprises among other things an annular space, a mixing chamber, an ignition chamber and a combustion chamber as well as a ring wall provided with radial canals and a burner plate.

According to the present invention, this is achieved by having the annular space also surround the ignition chamber and, the conically flared combustion chamber in ring fashion and extend up to the vicinity of the burner plate; by having a primary air supply stub open into the annular space at that point and by arranging baffles in the annular space which conducts the primary air stream being fed in from the primary air feed stub to the radial canals of the ring wall in a flow path winding, in spiral fashion or meander fashion, about the combustion chamber and the ignition chamber.

The gasification burner according to the present invention can advantageously be developed further in such a manner that:

the ignition chamber is separated from the combustion chamber by a perforated wall, preferably a perforated ceramic plate, and the perforated area of the burner plate is larger than the perforated area of the perforated wall;

a flame monitor aimed at the perforated wall is provided at the housing;

the side walls of the ignition chamber and the combustion chamber consist of metal and carry a ceramic lining;

at the height of the mixing chamber, the housing carries a flange extending laterally beyond the other housing parts and the flange has feed canals to the primary air feed stub and to a secondary air connection leading into the mixing chamber, as well as cutouts for the ignition electrodes arranged in the ignition chamber and, optionally, for flame monitoring.

DETAILED DESCRIPTION OF THE INVENTION

Figure 1:
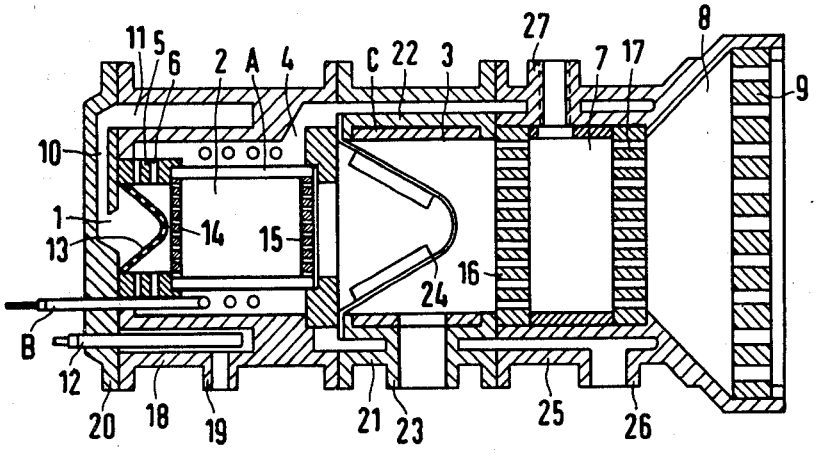
FIG 1 PRIOR ART
FIG. 1 is a cross section view of a prior art gasification burner.
Figure 2:
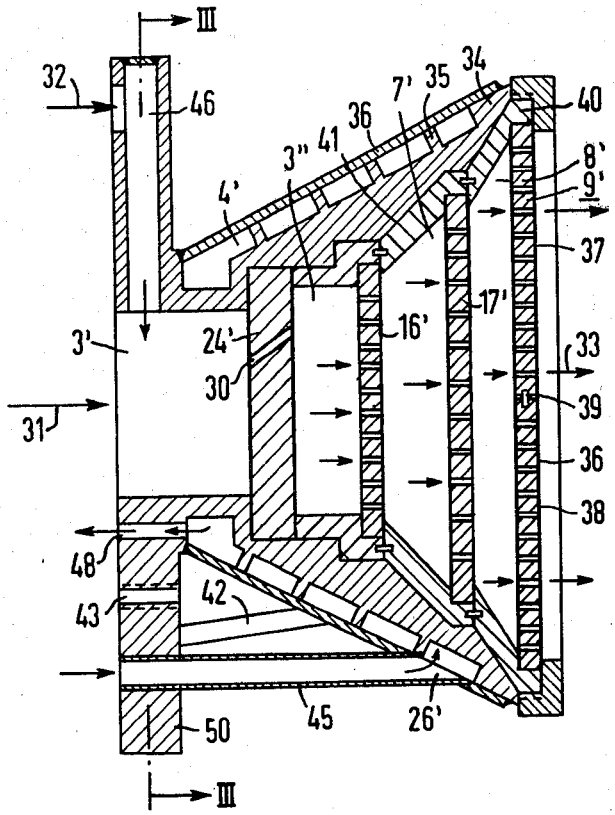
FIG. 2 is a cross section through the improved arrangement of the present invention for use with the burner of FIG. 1.

The improvements which the gasification burner according to the present invention exhibits over the gasification burner according to the previous patent application relate to the combustion part of the burner, i.e., the mixing chamber 3, the ignition chamber 7, the combustion chamber 8 and the burner plate 9, as well as the corresponding housing parts (see FIG. 1). FIG. 2 shows a longitudinal section through the combustion part of the gasification burner according to the present invention, and FIG. 3, a section along line III—III in FIG. 2.

Figure 3:
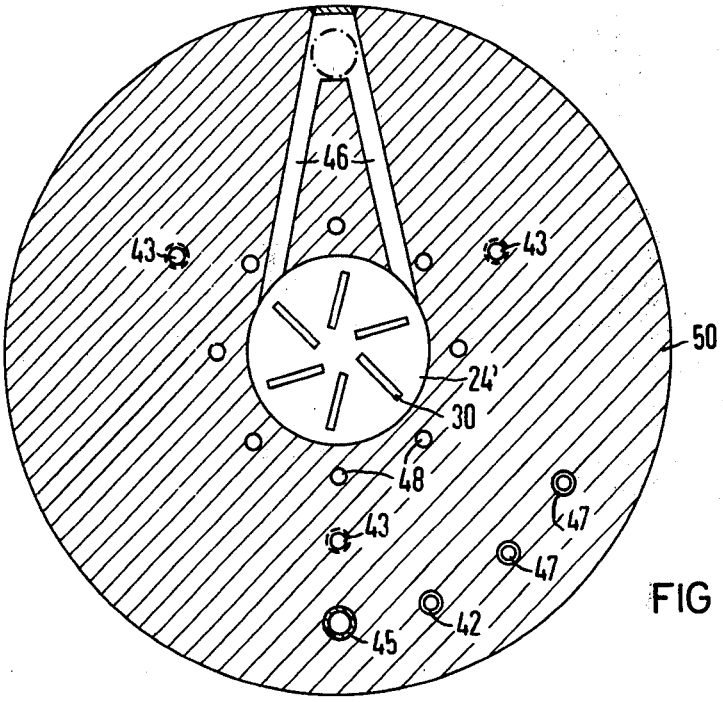
FIG. 3 is a section along line III—III of FIG. 2.

The gasification part, not shown in FIGS. 2 and 3, is followed by the mixing chamber, which is divided into two subchambers 3' and 3'' by a homogenizing device (swirl vane 24' with inclined slots 30). From the gasification part, fuel gas (arrow 31) which is mixed with secondary air (arrow 32) is fed to the mixing chamber. The mixture is conducted into the ignition chamber 7' through a backfire protection device 16', for instance, a perforated disc of porous ceramic. From the ignition chamber, the mixture flows through a perforated wall 17', which is advantageously a perforated ceramic plate, into the conically flared combustion chamber 8' and through the burner plate 9'. When flowing through the ignition chamber 7' and the combustion chamber 8', especially when passing through the perforated wall 17' and the burner plate 9', the fuel gas and air mixture is burned and enters the interior of a boiler as indicated by arrows 33. The chambers mentioned are surrounded by a solid housing part 34, in which an annular space 4' is arranged, to which primary air is fed via a primary air feed stub 26'.

In the gasification burner according to the present invention, the basic improvement is obtained by having the annular space 4' also enclose the ignition chamber 7' and the combustion chamber 8' in ring fashion and having it extend up to the vicinity of the burner plate 9'. There, the primary air stub 26' is arranged, so that the primary air comes into contact with the hot housing part 34 in the immediate vicinity of the hot burner plate 9' and cools the housing. In the annular space 4', the walls 35 are arranged, so as to make the annular space into a flow path which winds in spiral or meander fashion about the combustion chamber 8' and the ignition chamber 7'. This flow path can be realized by milling a screw thread like slot into the housing part 34 and fastening a conical cover plate 36 on the housing part. The primary air flowing in through the feed stub 26' comes into intensive thermal contact with the housing part 34 along this winding flow path and cools the housing part before it enters the antechamber 1 through the radial canals 6 in the ring wall 5, according to FIG. 1. This embodiment of the burner according to the present invention leads on the one hand to better preheating of the primary air and, on the other hand, prevents overheating the housing part 34, which for this reason can be made of metal, for instance, stainless steel, without the danger of the metal softening at the high combustion temperatures.

In one embodiment of the gasification burner according to the present invention, the combustion chamber 7' is also flared conically in the flow direction, the exit cross section of the ignition chamber being equal to the entrance cross section of the combustion chamber. It is particularly advantageous, however, if the ignition chamber 7' is separated from the combustion chamber 8' by the already mentioned perforated wall 17', the perforated area of the burner plate 9' being larger than the perforated area of the perforated wall 17'. Since therefore the flow cross section of the fuel gas/air mixture increases steadily between the mixing chamber 3' and the burner plate 9', the thermal stress of the perforated wall is smaller than in the gasification burner according to FIG. 1, and the danger of destruction of this perforated wall by thermal stresses is thus reduced. For, it has been shown that the perforated wall 17' is subjected to particularly high temperatures in burner operation, which can be seen from the bright glow. To avoid thermal destruction, it is furthermore advantageous if the burner plate 9' and, optionally, also the perforated wall 17' are composed of several plate parts such as 37 and 38 which are held together by a slot and key 39.

The burner housing of the gasification burner according to the present invention preferably consists of metal. In order to protect the housing from thermal destruction at high temperatures, the ignition chamber 7' and the combustion chamber 8' can also have a ceramic lining. This ceramic lining consists advantageously of individual ceramic rings 40 and 41, which can likewise be held together by a slot and key.

With the gasification burner according to the present invention, an additional improvement is obtained if a flame monitor aimed at the perforated wall 17' is provided at the housing. The flame monitor may be of an optical nature. To this end, the one end of an observation tube 42, for instance, can be fastened at a breakthrough of the ignition chamber wall; the other end carries a photocell, not shown in FIG. 2. If the perforated wall 17' glows, the photocell delivers a signal indicating proper operation. It delivers a trouble signal when the glow at the perforated wall 17' is extinguished, which can be used, for instance, for switching off the fuel supply. Optionally, a light guide can be provided between the observation tube 42 and the photocell in order to protect the photocell from the burner heat.

In the gasification burner according to the present invention, the housing part 34 can advantageously further be provided with a wide flange 50, at the end adjacent to the gasification part, i.e., at the height of the mixing chamber. The flange 50 extends laterally beyond the other housing parts. This flange can be used for fastening the burner to the wall of a boiler, an opening being provided in the boiler wall, into which the burner with the housing part downstream from the flange can be inserted and which is closed off by the flange (tapped holes 43). The combustion part of the burner is then arranged in the interior of the boiler, so that the thermal radiation of the burner part can likewise be utilized for heating purposes. Since the housing parts located in the interior of the boiler are then cooled by the primary air stream, there is no danger that these parts might overheat. The primary air is fed in by means of at least one feed canal 45 which goes through the flange and leads to the primary air feed stub 26'. The subspace of the annular space 4' located in the combustion part is connected via holes 48 to the part of the annular part located in front thereof. The secondary air is fed in by means of a feed canal 46 which likewise goes through the flange and leads to the secondary air connection of the mixing chamber 3'. In the flange 50 passages 47 for introducing ignition electrodes which are arranged at the ignition chamber wall, and optionally, for a flame monitor are also produced.

In the gasification burner according to the present invention, mullite can be used as the material for the ceramic parts, advantageously, up to 50% by weight Bikorit can advantageously be admixed to the mullite to increase the heat resistance. Aluminum oxide as well as aluminum fire clay composition (for instance, so-called filter core composition) are likewise suitable. However, other highly temperature-resistant ceramics, for instance, of the zirconium dioxide type, and also silicon carbide, can also be used. The burner plates and the perforated wall consist advantageously of the same material as the ceramic linings.

If in the operation of the burner according to the present invention, the amount of primary air is set for air numbers of about 0.1 and the amount of secondary air to about 1.0, temperatures of about 1740° C. are obtained. In spite of these high temperatures, however, there is no danger of thermal damage to the burner components. In addition, the efficiency of the burner is improved by the better preheating of the primary air and the reduction of the thermal radiation.

What is claimed is:

1. In a gasification burner comprising: a primary air feed stub; an antechamber for mixing an at least partly evaporated liquid fuel with primary air, having an inlet for evaporated liquid fuel and a primary air inlet; a catalytic device downstream of the antechamber for converting the fuel vapor air mixture into a fuel gas; a mixing chamber downstream of the catalytic device, and having inlets for said fuel gas and secondary air, for mixing the fuel gas with secondary air to form a fuel-gas mixture; means defining an annular space concentrically surrounding the antechamber, the catalytic device, the mixing chamber, said annular space separated from the antechamber by a ring wall, and having an inlet coupled to said primary air feed stub; a conically flared combustion chamber terminatd by a perforated burner plate of porous material; an ignition chamber arranged between the combustion chamber and the mixing chamber coupling the combustion chamber to the mixing chamber such as to feed the fuel gas-air mixture from the mixing chamber to the combustion chamber, said annular space also surrounding said ignition chamber; a front chamber, located upstream of the antechamber, which changes into a ring canal which surrounds the inlet for evaporated liquid fuel of the antechamber comletely and the annular space and the catalytic device at least over part of their length; a fuel inlet coupled to the end of said ring canal remote from said front chamber; a heat source contained in said ring canal for evaporating the fuel; a heat source contained in said annular space for preheating the primary air during the starting process and for aiding in the event of load changes; radial canals contained in said ring wall forming the primary air inlet to said antechamber and connecting said annular space to said antechamber; homogenizing devices, arranged in said antechamber and in said mixing chamber; and means separating said ignition chamber from said mixing chamber such as to prevent backfiring, the improvement comprising:

(a) the annular space also enclosing the conically flared combustion chamber in ring fashion and extending up to the immediate vicinity of the burner plate;

(b) the primary air feed stub opening into the annular space in the immediate vicinity of the burner plate; and (c) baffles disposed in said annular space conducting the primary air stream being fed in from said primary air feed stub to the radial canals of the ring wall in a winding flow path about the combustion chamber and the ignition chamber.

2. The improvement according to claim 2, and further including a perforated wall separating the ignition chamber from the combustion chamber and wherein the perforated area of the burner plate is larger than the perforated area of said perforated wall.

3. The improvement according to claim 2, and further including a flame monitor in the wall of ignition chamber aimed at said perforated wall.

4. In a gasification burner comprising: a primary air feed stub; an antechamber for mixing an at least partly evaporated liquid fuel with primary air, having an inlet for evaporated liquid fuel and a primary air inlet; a catalytic device downstream of the antechamber for converting the fuel vapor air mixture into a fuel gas; a mixing chamber downstream of the catalytic device, and having inlets for said fuel gas and secondary air, for mixing the fuel gas with secondary air to form a fuel gas-air mixture; means defining an annular space concentrically surrounding the antechamber, the catalytic device, the mixing chamber, said annular space separated from the antechamber by a ring wall, and having an inlet coupled to said primary air feed stub; a conically flared combustion chamber terminated by a perforated burner plate of porous material; an ignition chamber arranged between the combustion chamber and the mixing chamber coupling the combustion chamber to the mixing chamber such as to feed the fuel gas-air mixture from the mixing chamber to the combustion chamber, said annular space also surrounding said ignition chamber; a front chamber, located upstream of the antechamber, which changes into a ring canal which surrounds the inlet for evaporated liquid fuel of the antechamber completely and the annular space and the catalytic device at least over part of their length; a fuel inlet coupled to the end of said ring canal remote from said front chamber; a heat source contained in said ring canal for evaporating the fuel; a heat source contained in said annular space for preheating the primary air during the starting process and for aiding in the event of load changes; radial canals contained in said ring wall forming the primary air inlet to said antechamber and connecting said annular space to said antechamber; homogenizing devices, arranged in said antechamber and in said mixing chamber; and means separating said ignition chamber from said mixing chamber such as to prevent backfiring, the improvement comprising:

(a) the annular space also enclosing the conically flared combustion chamber in ring fashion and extending up to the immediate vicinity of the the burner plate;

(b) the primary air feed stub opening into the annular space in the immediate vicinity of the burner plate;

(c) baffles disposed in said annular space conducting the primary air stream being fed in from said primary air feed stub to the radial canals of the ring wall in a winding flow path about the combustion chamber and the ignition chamber; and (d) the ignition chamber being conically flared out in the flow direction and the exit cross section of the ignition chamber being equal to the entrance cross section of the combustion chamber.

5. The improvement according to claim 2 wherein the side walls of the ignition chamber and the combustion chamber consist of metal with a ceramic lining.

6. The improvement according to claim 5, wherein said ceramic lining is composed of ceramic rings.

7. The improvement according to claim 6 wherein said burner plate and said perforated wall are composed of several plate parts.

8. The improvement according to claim 7, wherein said ceramic rings and plate parts, respectively, are connected to each other by a slot and key.

9. The improvement according to claim 2 and further including a flange in the area height of the mixing chamber, said flange laterally extending beyond the other parts, and having feed canals to the primary air feed stub and to a secondary air connection leading to the mixing chamber as well as breakthroughs for ignition electrodes disposed at the ignition chamber.

10. The improvement according to claim 9, wherein said flange includes means for fastening it to the wall of a boiler.

11. The improvement according to claim 9, wherein said flange has a breakthrough for a flame monitor.

* * * * *